United States Patent [19]

Schrecongost

[11] 4,016,792

[45] Apr. 12, 1977

[54] MONOPHONIC ELECTRONIC MUSICAL INSTRUMENT

[75] Inventor: Ray B. Schrecongost, Park Ridge, Ill.

[73] Assignee: Hammond Corporation, Chicago, Ill.

[22] Filed: Mar. 4, 1974

[21] Appl. No.: 448,020

[52] U.S. Cl. ..... 84/1.01; 84/DIG. 2; 84/DIG. 20

[51] Int. Cl.[2] ..... G10H 5/06

[58] Field of Search ..... 84/1.01, 1.24, DIG. 2, 84/DIG. 20, DIG. 25

[56] References Cited

UNITED STATES PATENTS

| | | | |
|---|---|---|---|
| 2,710,555 | 6/1955 | Martin | 84/1.01 |
| 2,874,286 | 2/1959 | Bode | 84/DIG. 2 |
| 2,933,004 | 4/1960 | Hanert | 84/1.01 |
| 3,470,306 | 9/1969 | Hadden | 84/DIG. 2 |
| 3,476,864 | 11/1969 | Munch, Jr. et al. | 84/DIG. 2 |
| 3,509,262 | 4/1970 | Munch, Jr. | 84/1.01 |
| 3,598,892 | 8/1971 | Yamashita | 84/1.01 |
| 3,719,767 | 3/1973 | Matumoto et al. | 84/1.01 |
| 3,760,358 | 9/1973 | Isii et al. | 84/1.01 X |
| 3,766,305 | 10/1973 | Schrecongost | 84/1.01 |
| 3,781,450 | 12/1973 | Nakajima | 84/1.01 |
| 3,806,623 | 4/1974 | Yamada | 84/1.01 |
| 3,836,692 | 9/1974 | Nakajima | 84/1.01 |

*Primary Examiner*—Stanley J. Witkowski
*Attorney, Agent, or Firm*—Neuman, Williams, Anderson & Olson

[57] ABSTRACT

A monophonic electronic music synthesizer in which keying signals are collected on common note busses and common octave busses. Tone signals from a top octave tone generator are gated by separate note gates controlled by keying signals on common note busses to select the note tone signal regardless of octave. A chain of frequency dividers fed by the note tone signal produce octavely related tone signals which are gated by separate octave gates controlled by keying signals on common octave busses. A preferred embodiment especially useful in an integrated organ-synthesizer system employs a low octave lockout circuit to select an active highest octave of actuated keyswitches and a preference gating arrangement for tone signals to produce high note select gating of monophonic tone signals. A D.C. keyed volts per octave circuit is also disclosed.

12 Claims, 7 Drawing Figures

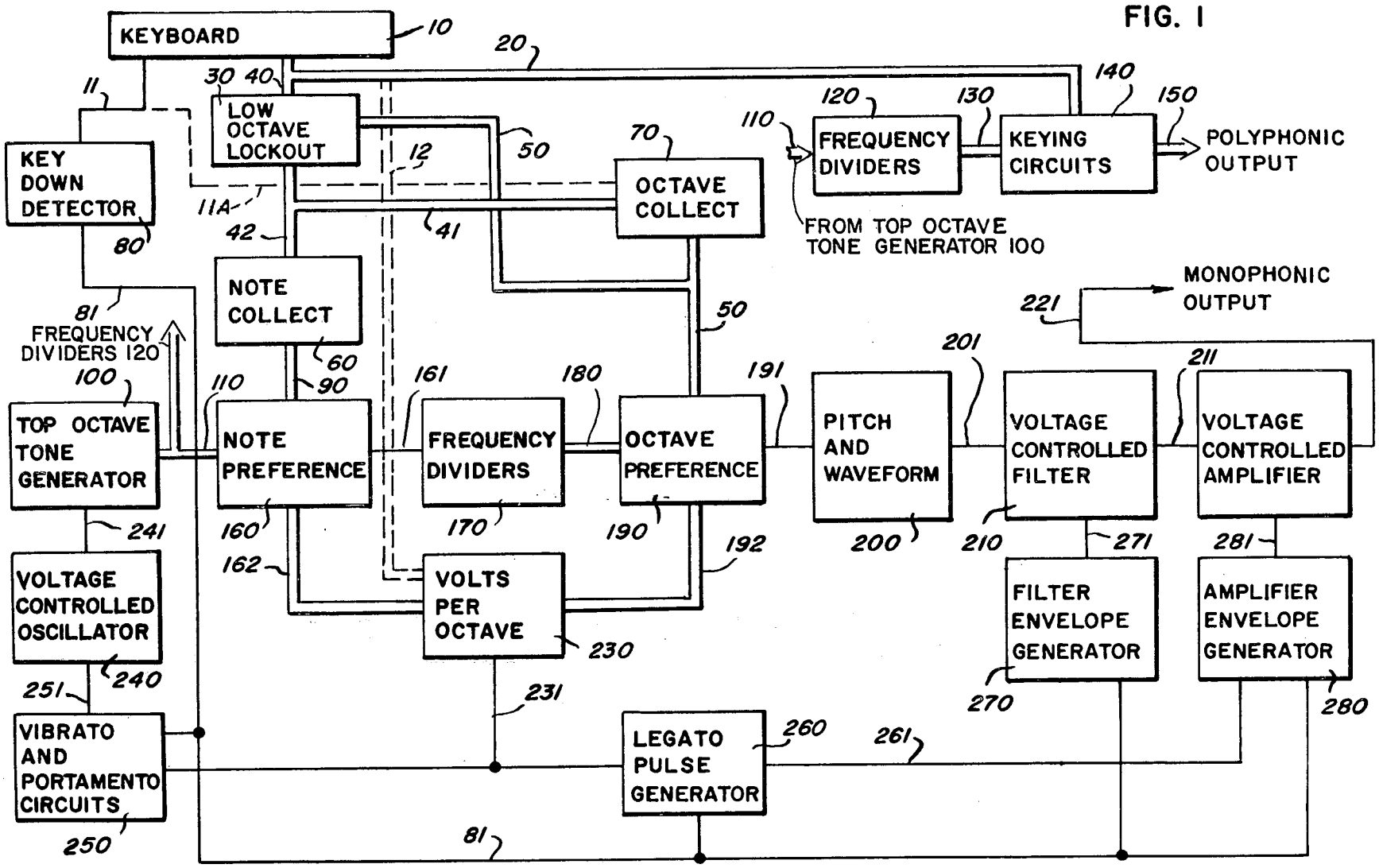
FIG. 1
POLYPHONIC OUTPUT
MONOPHONIC OUTPUT
KEYING CIRCUITS
FREQUENCY DIVIDERS
FROM TOP OCTAVE TONE GENERATOR 100
VOLTAGE CONTROLLED AMPLIFIER
AMPLIFIER ENVELOPE GENERATOR
VOLTAGE CONTROLLED FILTER
FILTER ENVELOPE GENERATOR
PITCH AND WAVEFORM
OCTAVE COLLECT
OCTAVE PREFERENCE
LEGATO PULSE GENERATOR
FREQUENCY DIVIDERS
VOLTS PER OCTAVE
KEYBOARD
LOW OCTAVE LOCKOUT
NOTE COLLECT
NOTE PREFERENCE
KEY DOWN DETECTOR
FREQUENCY DIVIDERS 120
TOP OCTAVE TONE GENERATOR
VOLTAGE CONTROLLED OSCILLATOR
VIBRATO AND PORTAMENTO CIRCUITS

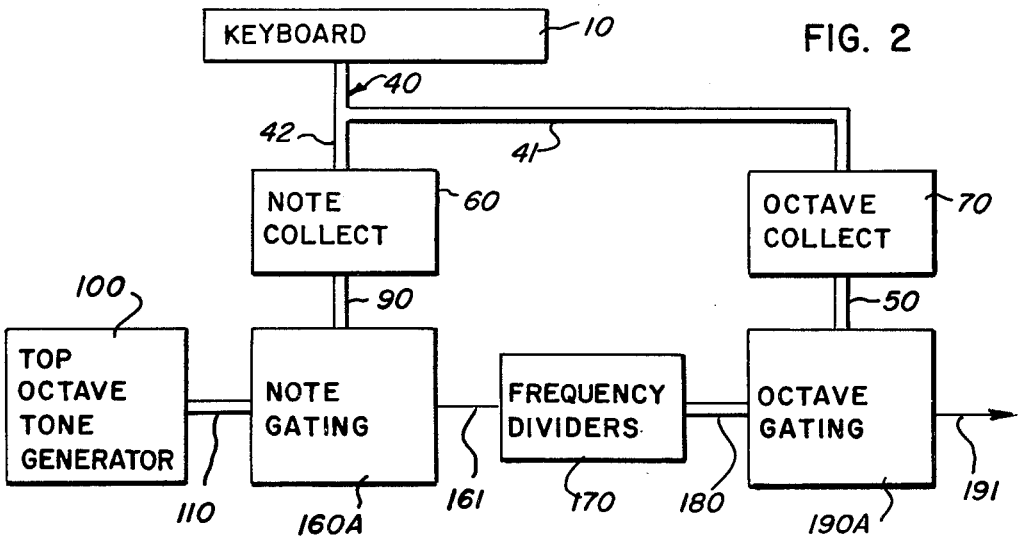
FIG. 2
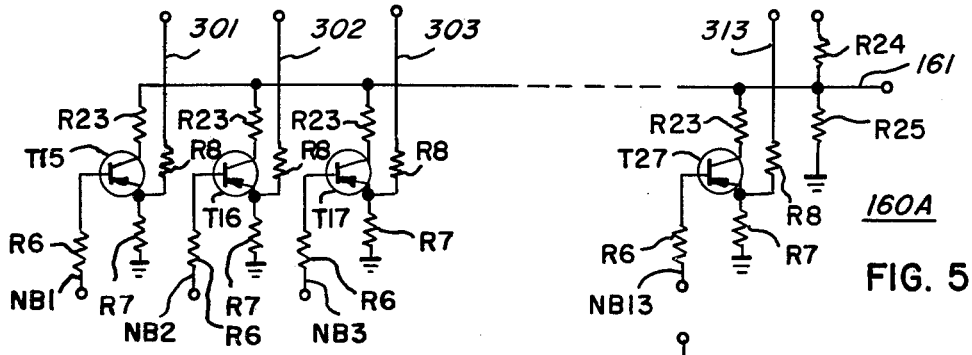
FIG. 5
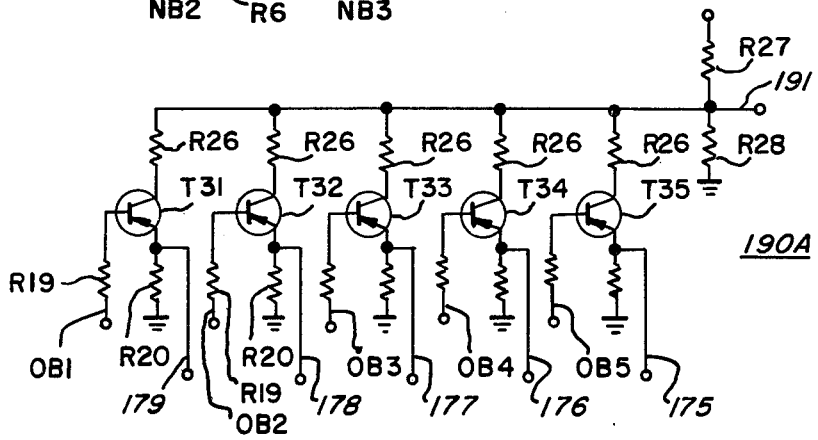
FIG. 6
FIG. 7
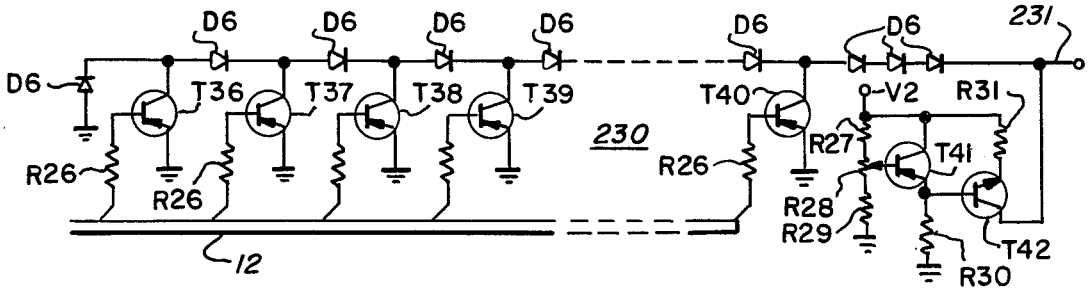

MONOPHONIC ELECTRONIC MUSICAL INSTRUMENT

FIELD OF THE INVENTION

This invention relates to monophonic electronic musical instruments and more particularly to electronic music synthesizers for simulating various orchestral instrument voices and for producing unique musical and non-musical sounds.

DESCRIPTION OF PRIOR ART

Electronic music synthesizers are typically monophonic instruments which involve generating a tone signal of a selected frequency and waveshape and subjecting the tone signal to controlled frequency modulation, controlld filtering, and controlled amplification to produce the desired musical effect. By providing a frequency modulation, controlled filtering, and controlled amplification of waveshapes and dynamic changes in frequency, filtering, and amplification, as well as controlled introduction of noise, various types of orchestral instrument voices can be authentically simulated and unique sounds not made by familiar musical instruments can be generated.

The commercially available synthesizers marketed under the trade names "Moog" and "ARP" have generally similar system characteristics. A keyboard, which is generally similar to a piano or organ keyboard, is provided with keyswitches for each key having a plurality of contact pairs for different control functions. One contact pair per key is employed to ground a junction in a precision resistor divider string fed by a constant current source to develop a voltage at the output of the current source which is linearly related to the position of the actuated key on the keyboard. Other contact pairs are employed to produce a "keydown" signal, i.e., a signal that at least one key is depressed, and a "legato pulse" signal, i.e., a signal that a new effective key is depressed. The constant current source and precision resistor divider string comprise a "volts per octave" circuit which responds only to the lowest or highest key actuated depending upon whether the current source feeds the divider string from the low end or high end of the keyboard.

The output voltage signal from the volts per octave circuit is fed to a sample and hold circuit which functions under the control of the legato pulse generator to store or memorize the voltage signal so that it is available even if the actuated key is released. The memorized voltage signal is fed to a circuit which converts the linear volts per octave signal to an exponential signal. This exponentially varying signal has the proper characteristic to control a voltage-controlled oscillator which thus produces an output tone signal corresponding to the note associated with the actuated key on the keyboard. The output tone signal is fed to a voltage-controlled filter which may be programmed to have various frequency response characteristics including dynamic characteristics produced by a circuit which produces voltage control envelopes of various types. Then the filtered signal is further processed in a voltage-controlled amplifier which may be programmed via a circuit which produces various types of voltage control envelopes to amplitude modulate the signal. Moreover, the voltage-controlled oscillator itself may be subjected to various types of modulation to produce vibrato and other musical effects.

Several years ago, the Wurlitzer Company introduced a synthesizer as an optional add-on feature to several of its electronic organ models. The synthesizer was controlled via a two-octave keyboard separate from the solo keyboard of the organ and thus the player could not play the synthesizer integrally with upper manual solo voices. The Wurlitzer synthesizer employs a single oscillator-parallel divider chain approach to generating the top octave tone signals. These top octave tone signals are directly fed to a first priority latching network which is coupled to one octave of keyboard switches. The top octave tone signals are also sent through individual frequency dividers to generate the next lowest octave of tones and then are fed to a second priority latching network. A complex arrangement of parallel frequency dividers fed by the two priority latching networks is controlled by a steering circuit to provide selection between the two octaves.

The Baldwin Piano and Organ Company and Thomas Organ Company have within the past couple of years introduced organ models with built-in synthesizers functioning under the control of the upper keyboard of the organ. Both companies employ a contact pair per key in addition to regular organ keying contacts to generate a high select voltage signal to a sample and hold circuit for tuning a voltage-controlled oscillator.

Thus, these companies have chosen to integrate the type of tone generation system used in Moog and ARP units and to control the tone generation system via additional contacts per key.

SUMMARY OF THE INVENTION

This invention provides a monophonic electronic musical instrument which has advantages as a stand-alone unit and which is very advantageously integrated into electronic organs having D.C. keying systems without requiring additional keyboards or additional contact pairs on existing keyboards in the organ. The invention features a monophonic tone generation system using a top octave tone signal generator with note collect and gating circuits for selectively gating one of the top octave tone signals, a frequency divider chain to produce lower octave versions of the gated tone signal, and octave collect and gating circuits for selectively gating the appropriate octave version according to the octave in which the note is played.

More specifically, a note collect circit collects the D.C. keying signals from a keyboard having a single contact pair per key with all common notes in different octaves being collected on one bus. That is, all C note keying signals, C1, C2, C3, etc., are collected on a common C note bus; all C # keying signals, C1 #, C2 #, C3 #, etc., are collected on a common C # note bus; and so forth for all of the other notes of the musical scale. At the same time, an octave collect circuit collects the D.C. keying signals from the keyboard with all notes in a common octave being collected on one bus. That is, all notes in octave one, C1, C1 #, D1, D1 #, E1, F1, etc., are collected on an octave one bus; all notes in octave two, C2, C2 #, D2, etc., are collected on an octave two bus; and so forth for all of the octaves.

Each common note bus controls a gating circuit for its associated top octave tone signal so that, for example, any C note played in any octave puts a keying signal on the common C note bus which, in turn, gates through the top octave C note. Assuming C5 is the top octave C note, this gated tone signal is divided in four frequency divider stages to produce C4, C3, C2, and C1 tone signals. Each common octave bus controls a gating circuit for its associated octave tone signals so that, for example, if C3 is played the C3 signal will be gated from the appropriate frequency divider stage. Thus, the common note busses operate gating circuits for the appropriate top octave tone signals to select the tone corresponding to the key played regardless of the octave in which it is played, and the common octave busses operate gating circuits to select the proper octavely related tone signal from the frequency divider chain.

In a preferred embodiment which is especially useful in an integrated organ-synthesizer system, a low-octave lockout circuit is provided. This lockout circuit senses a keying signal on one of the common octave busses and responds by locking out all keying signals from lower keyboard octaves so that only the highest octave in which a key is actuated is effective. Also, the tone gating circuits preferably comprise a preference gating arrangement so that only the top octave tone signal corresponding to the highest key actuated in the active octave is effectivelty gated to an output. Together this provides high tone signal and high octave preference gating such that only when the tone signal corresponding to the highest note played on the keyboard of the unit, whether a separate stand-alone unit, or an upper keyboard of an organ, will be produced. In an integrated organ-synthesizer system the low octave lockout circuit is readily isolated from the regular organ D.C. keying so that polyphonic organ voices and monophonic synthesizer voices are controlled by the sane single set of key contacts on the upper keyboard of the organ.

This same inventive concept is also employed in the specific embodiments of synthesizer systems disclosed in copending Mathias and Schrier patent applications bearing Ser. Nos. 447,907 and 447,905, respectively, each having a filing date of Mar. 4, 1974, and being commonly assigned to Hammond Corporation, the assignee of this invention, and it is to be understood that the disclosures of those applications represent additional preferred embodiments of this invention known to this applicant and are specifically incorporated herein by reference.

BRIEF DESCRIPTION OF THE DRAWINGS

FIG. 1 is a block schematic diagram of an electronic music synthesizer according to one embodiment of this invention.

FIG. 2 is a block schematic diagram of an alternate embodiment of this invention.

FIGS. 5 and 6 are circuit schematic diagrams of note and octave tone signal gating circuit portions of the alternative embodiment shown in FIG. 2.

FIG. 7 is a circuit schematic diagram of a volts per octave circuit useful in a system according to this invention.

DETAILED DESCRIPTION

Figure 3:
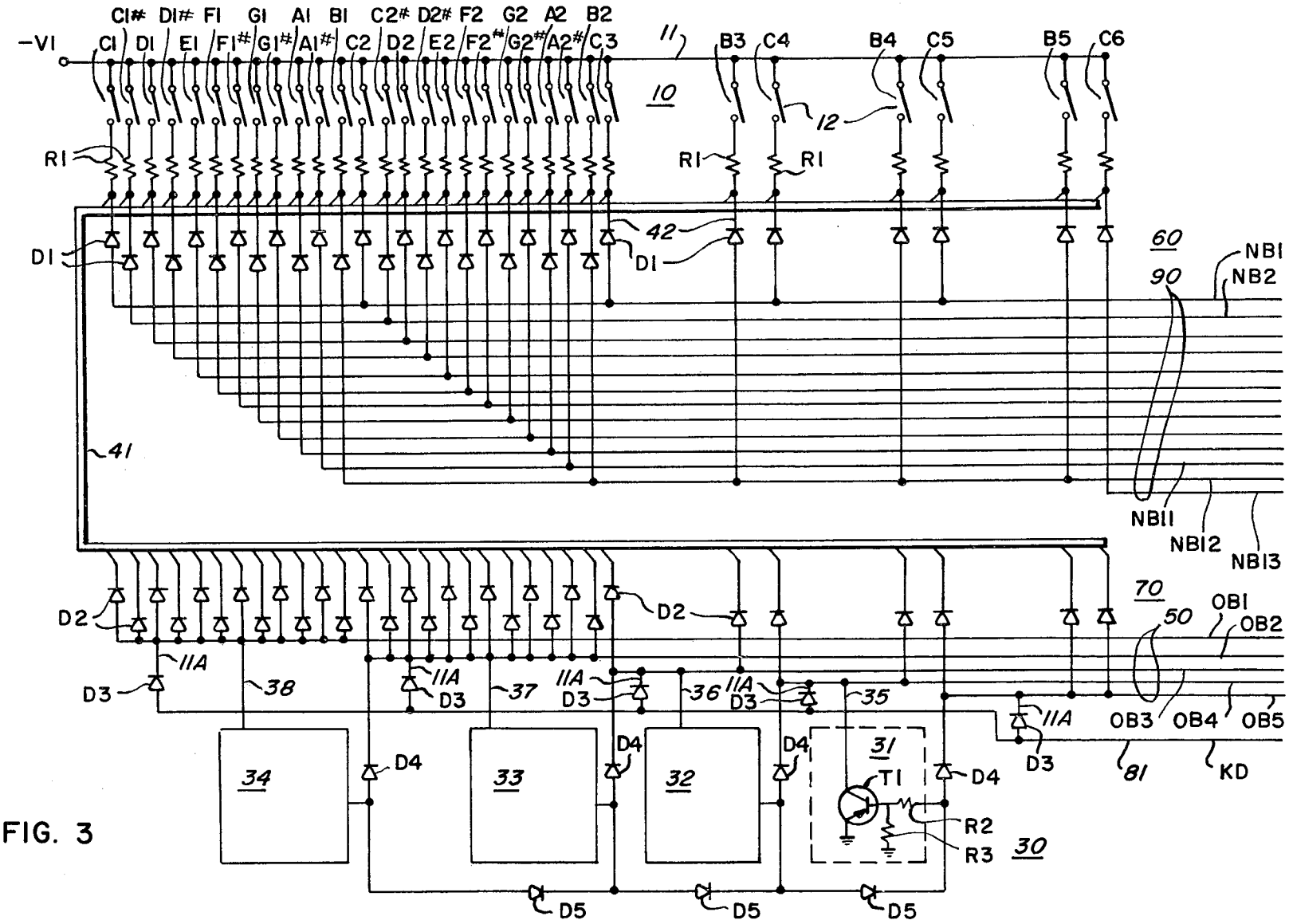
FIGS. 3 and 4 together comprise an essentially circuit schematic diagram of portions of the embodiment of this invention shown in FIG. 1.

FIG. 1 shows a complete synthesizer system employing a monophonic tone generating system according to this invention. Keyboard 10 produces control signals which are fed via cable 20 to keying circuits 140 which are regular polyphonic organ tone signal keying circuits. Top octave tone generator 100 generates the highest octave of tone signals which are fed via cable 110 to frequency dividers 120 which comprise parallel chains of frequency dividers to generate other octaves of tone signals to be fed to keying circuits 140. Each of the actuated control elements in keyboard 10 operates one or more individual keying circuits in block 140 to produce polyphonic tone signal outputs on cable 150 as in a regular electronic organ system. Preferably the polyphonic organ system employs large scale integrated circuits to perform the top octave tone generation, frequency division, and D.C. keying as is characteristic of recent models of organs introduced by Hammond Organ Company. It would also be preferable to employ a separate oscillator and top octave tone generator to feed frequency dividers 120 so that animation of polyphonic organ signals will be independent of animation of monophonic synthesizer signals. U.S. Pat. Nos. 3,534,144 and 3,636,231 disclose integrated circuit approaches to stairstep synthesis keying for formant organ voices and drawbar synthesis keying for sine wave synthesis organ voices.

Keyboard 10 is preferably a single contact per key system and the D.C. keying control signals from actuated keys which are fed via cable 20 to organ keying circuits 140 are also sent via cable 40 through low octave lockout circuit 30 to note collect circuit 60 and octave collect circuit 70 via cable branches 42 and 41. The output signals from note collect circuit 60 are coupled via cable 90 to note preference circuit 160. The output signals from octave collect circuit 70 are fed via cable 50 to low octave lockout circuit 30 and to octave preference circuit 190. Signals from octave collect circuit 70 cause low octave lockout circuit 30 to lock out all control signals from keyboard 10 except those corresponding to the highest octave in which keys are actuated. This lockout is effective only for control signals fed to octave collect circuit 70 and note collect circuit 60 and does not affect the transmission of control signals to organ keying circuits 140 because of isolation resistors (not shown) within keyboard 10. As a result of low octave lockout circuit 30 only one octave of keys, namely that of the highest actuated key, is active with respect to the synthesizer portion of the system. This synthesizer system will be described in terms of a high select system which is considered to be more useful when the upper or solo keyboard of an organ is used to control the synthesizer since the melody note is usually the highest note played in polyphonic playing and the synthesizer is essentially a melody instrument. It should be readily apparent that a low select system could be provided for a stand-alone version of the synthesizer system and would be essentially the reverse of the approach to be described herein. It should also be apparent that a combined low and high select system could also be provided by duplicating the necessary circuitry.

Top octave tone generator 100 generates at least the top octave of twelve tone signals on cable 110. The highest C note may also be generated as a thirteenth tone signal. These tone signals on cable 110 feed note preference circuit 160 which is controlled by signals from note collect circuit 60 to gate onto output lead 161 only the tone signal corresponding to the highest note played in the active octave. Divider 170 divides the tone signal on lead 161 into octavely related tone signals on cable 180. Octave preference circuit 190 functions under the control of signals from octave collect circuit 70 to gate onto lead 191 the appropriate one of the octavely related tone signals from divider 170 corresponding to the octave in which the highest key is actuated. The tone signal on lead 191 thus corresponds to the highest key actuated in the active (highest) octave in which keys are actuated. Low octave lockout circuit 30 prevents any higher key actuated in a lower octave from affecting note preference circuit 161 and thereby precludes erroneous tone signal selection when plural keys in different octaves are actuated. This important feature of this invention will be more clearly brought out in the description below of the actual circuitry shown in FIGS. 3 and 4.

The high tone signal on lead 191 is fed to pitch and waveform circuits 200 wherein various different pitches may be selected and different waveforms produced. The selected tone signal of selected pitch and waveform is fed to a voltage-controlled filter 210, thence to a voltage-controlled amplifier, and finally to an output speaker system. Pitch and waveform circuits 200, voltage-controlled filter 210, voltage-controlled amplifier 220, top octave tone generator 100, voltage-controlled oscillator 240, vibrato and portamento circuits 250, filter envelope generator 270, amplifier envelope generator 280, and legato pulse generator 260 are not specifically a part of this invention and thus are not discussed in detail herein. Specific versions of volts per octave circuit 230 and keydown detector 80 are shown in FIGS. 3 and 7, respectively, and are described below. It will be apparent to those skilled in the art of electronic synthesizers that various types of circuitry could be employed in these blocks to accomplish the required functions. However, to complete the disclosure of an overall synthesizer system, the disclosures above-referenced copending and commonly assigned Mathias and Schreier patent applications, are specifically incorporated herein by reference. Each of these two copending patent applications discloses certain improvement inventions which also employ the inventive concepts disclosed herein.

FIG. 2 illustrates an alternative embodiment of this invention employs note gating 160A in place of note preference 160 and octave gating 190A instead of octave preference 190 and is limited to strict one-key-at-a-time or detached playing in order to avoid tone signal confusion which would occur if two keys were coincidentally actuated. A third variant of the invention would comprise the system of FIG. 1 without low octave lockout circuit 30. Such a system would properly select the highest tone signal if several keys were actuated in the same octave or if the highest note played in the highest octave were higher than the highest played in lower octaves. However, the combined playing of a low note in one octave and a high note in a lower octave would cause the system to produce the higher note of the lower octave but at the higher octave frequency. Thus neither of these variant systems would be very satisfactory in an integrated organ-synthesizer system in which it is desired to permit full polyphonic playing on the upper manual.

FIG. 3 illustrates, in detail, keyboard 10, low octave lockout circuit 30, octave collect circuit 70, note collect circuit 70 and keydown detector 80. Keyboard 10 comprises a typical one-contact-per-key organ keyboard such as is typically employed in modern organs of the D.C. keying variety. A D.C. keying bus 11 feeds a number of keyswitches 12—one for each key on the keyboard of the organ or stand-alone synthesizer unit. Two complete octaves of keyswitches are shown for the notes C through B2 and the first and last keyswitches only for octaves three through five and one keyswitch for C6. Keying bus 11 is coupled to a source of negative keying voltage −V1 which is typically −28 volts. The invention will be described in terms of negative D.C. keying signals, but it should be apparent that positive keying signals could also be employed if obvious adjustments are made in diode directions, transistor types, and bias voltage.

Diodes D1 comprise note collect circuit 60. Each keyswitch corresponding to a C note in each octave is coupled via a diode D1 to common C note bus NB1. Thus any one or more C note keyswitches will place a negative D.C. voltage on bus NB1 through a resistor R1. Corresponding all C note keying signals are collected, through a resistor R1 and a diode D1, on bus NB2; all D note keying signals are collected on bus NB3, and so forth for all of the notes of the musical scale.

At the same time, cable 41 carries each of the keying signals to diodes D2 which comprise octave collect circuit 70. All of the keyswitches in the first keyboard octave are coupled through resistors R1 and diodes D2 to first octave bus OB1. Similarly, all keyswitches in the second through fifth keyboard octaves, respectively, are coupled to separate busses OB2 to OB5. Keyswitch C6 is a special case, and in this instance is considered part of the fifth octave and is collected on a separate note bus NB13.

In effect, diodes D1 comprise a plurality of logic OR gates for the notes of the musical scale and diodes D2 comprise a plurality of logic OR gates for the octaves of the keyboard. Also, diodes D1 isolate common note busses from keying signals on common octave busses and vice versa for diodes D2.

Diodes D3 comprise a logic OR gate fed by the five common octave busses which functions as a keydown detector 80. Lead 81 will have a negative D.C. voltage thereon whenever any one or more of the keyswitches 12 are actuated and zero volts when no keyswitches 12 are actuated.

Gating circuits 31 through 34 together with diodes D4 and D5 interconnected as shown comprise low octave lockout circuit 30. Transistor T1 in gating circuit 31 will be turned on to a saturated condition by a negative keying signal on common octave bus OB5. Ground reference on the emitter of transistor T1 will appear also at its collector and ground out bus C6. Similar circuitry in blocks 32 to 34 will be operated by the negative keying voltage fed along a diode string comprising diodes D5, and will thus ground out busses OB1 to OB3. Thus, operation of any one or more of the keyswitches 12 associated with notes C5 through C6 will place a negative keying control signal on bus OB5 and lockout circuit 30 will thereupon ground out busses OB1 to OB4. The grounds on busses OB1 to OB4 are fed back through diodes D2 connecting those busses to the junctions of resistors R1 and diodes D1 associates with the first four octaves of keyswitches associated with notes C1 through B4. Consequently, if any one or more of these keyswitches is operated, they cannot place any keying potential on any of the common note busses because of grounded common octave busses. However, polyphonic organ keying circuits would be cabled into the keyswitch side of resistors R so that keying voltage developed across resistors R1 will operate corresponding D.C. keying circuits for any of the notes C1 through B4 whose keyswitches are actuated.

In a similar manner, if one or more keyswitches in the fourth keyboard octave C4 to B4 are actuated, but none of C5 to C6 are actuated, negative keying potential is fed to bus OB4. This negative voltage operates gating circuit 32 to ground out bus OB3 and is also fed to the left only through diodes D5 to operate circuits 33 and 34 to ground out busses OB1 and OB2. Under these conditions only keyboard octave four is active to produce keying signals on common note busses NB1-NB12 because all other keyboard octaves are locked out. Similar explanations hold for activating only octave three and octave two. In general, then, only the highest keyboard octave in which at least one keyswitch is actuated will be permitted to place keying signals on common note busses NB1 to NB13. This is necessary to provide an unambiguous high note select system as will be shown below by a detailed example.

Figure 4:
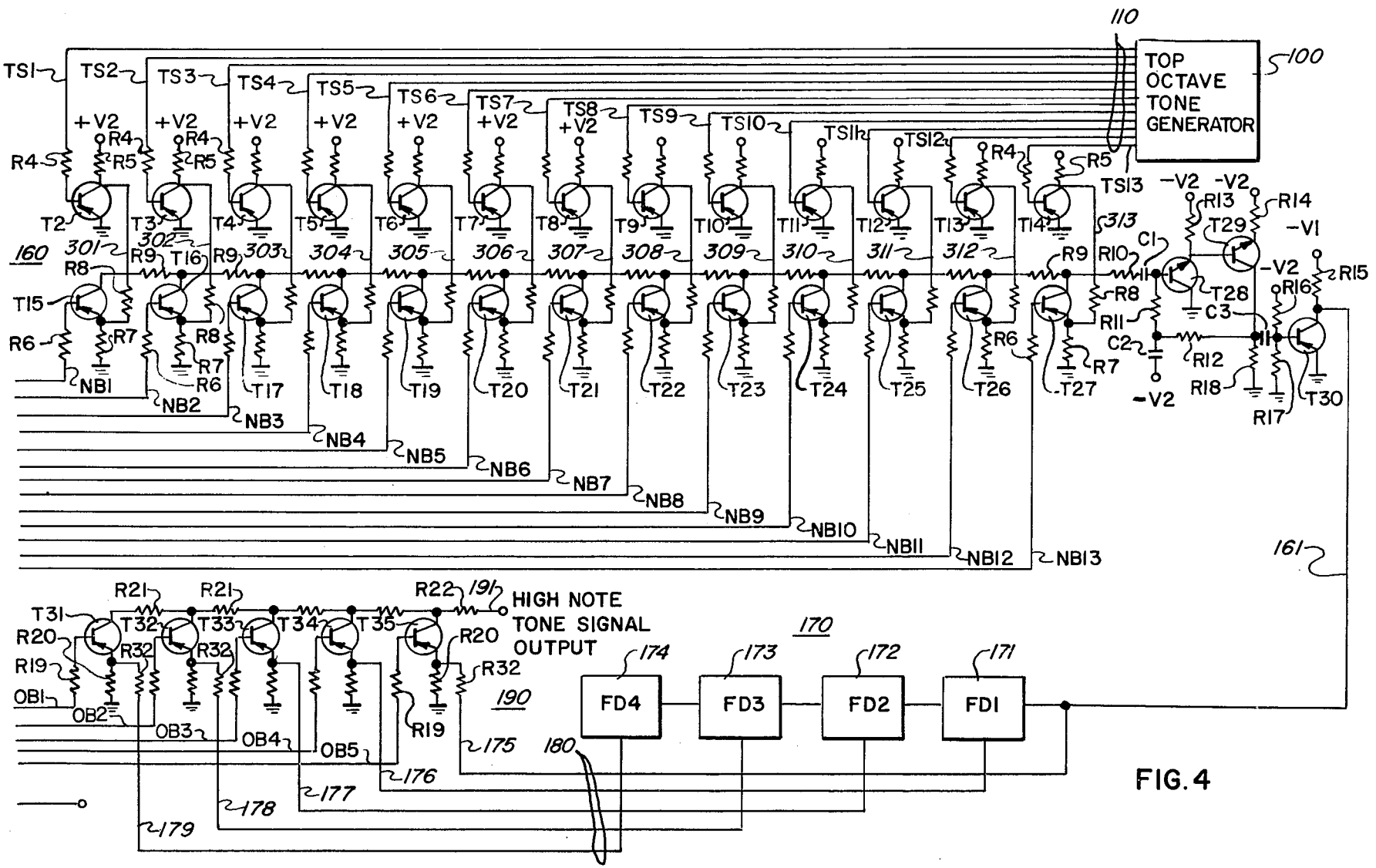

FIG. 4 illustrates top octave tone generator 100, note preference circuit 160, frequency dividers 170, and octave preference circuit 190. Top octave tone generator 100, which preferably comprises parallel divider chains driven by a single master oscillator, generates rectangular tone waveforms at the top octave frequencies C5 through B5 on tone signal busses TS1 through TS12 and also the C6 tone signal on bus TS13. Each of the tone signal busses TS1 to TS13 is coupled to one of the buffer amplifier circuits comprising transistors T2 to T14 and associated base and collector resistors R4 and R5. The outputs of these buffer amplifiers are fed via leads 301 to 313 to the emitters of individual gating transistors T15 to T27 which are interconnected in a preference-gating arrangement (including resistors R6 to R9) which permits only the highest gate tone to reach tone signal output lead 161. This preference gating arrangement is disclosed in Schrecongost U.S. Pat. No. 3,766,305 and will not be discussed in detail here since the operation is adequately described in that patent. Each of the transistors T15 to T27 is gated on whenever a negative keying signal is present on an associated one of common note busses NB1 to NB13. If more than one common note bus has a keying potential thereon, more than one of the transistors T15 to T27 will operate, but only the one associated with the highest note will be effective to gate its associated tone signal through to a recovery amplifier comprising transistors T28 and T29 and related circuit components R10 to R14, R18, C1, and C2 and to a preamplifier circuit comprising transistor T30 and its related circuit components R15 to R17, and C3.

The high note tone signal appearing on tone signal lead 161 is fed to a chain of four frequency dividers FD1 to FD4 and via lead 175 to a transistor gate comprising transistor T35 and related circuit components R19, R20, R32. Output leads 176 to 179 from dividers FD1 through FD4, respectively, couple octavely related tone signals to transistor gates comprising transistors T31 through T34 and related circuitry. These transistor gates are shown connected in a similar preference gating arrangement including resistors R21 and R22 such that only the highest gated tone reaches high note tone signal output lead 191. Transistors T31 to T35 are gated on by negative keying potential on common octave busses OB1 to OB5 respectively. However, with octave lockout circuit 30 (FIG. 3) octave gating circuit 190 need not be of the preference gating type because only one common octave bus at a time can have a negative keying potential thereon and thus only one transistor gate can be on at any one time.

To illustrate the operation of the circuitry of FIGS. 3 and 4 by a specific example, assume an A minor chord is played on keyboard 10 by actuating keyswitches A3, C4 and E4. With E4 keyswitch actuated, a negative keying signal is placed on common octave bus OB4 which turns on transistor T34 in octave preference gating circuit 190. At the same time, a negative keying signal is placed on common note bus NB4 which turns on transistor T19 in note preference gating circuit 160. Octave lockout circuit 30 responds to the signal on bus OB4 to ground out common octave busses OB1 through OB3. The ground on bus OB3 is fed back to prevent the keying signal from the A3 keyswitch appearing on common note bus NB9 and thus prevents transistor T23 is note preference circuit 160 from turning on. However, the keying signal from keyswitch C4 is not grounded out and its appearance on bus NB1 causes transistor T15 to turn on. With both transistors T19 and T15 on, preference circuit 160 selects top octave note E5 as the only one to be gated onto lead 161 and to be divided in frequency dividers FD1 to FD4.

Accordingly signal leads 175 through 179 have tone signals corresponding to E5, E4, E3, E2, and E1 thereon. Since only transistor T34 is gated on by the signal on bus OB4, only the E4 signal on lead 176 will be gated out on lead 191, and this corresponds to the highest note of the chord played on keyboard 10.

From the above example, it should be apparent that, if low octave lockout circuit 30 were not present, playing the notes A3, C4, and E4 would place keying potential on common note busses NB1, NB5, and NB9 as well as common octave busses OB3 and OB4. The signal on bus NB9 would gate on transistor T23 in preference circuit 160, which would be gated to lead 161 in spite of concurrent gating on of transistors T15 and T19 by signals on busses NB1 and NB5. The signals on leads 175 to 179 would be octavely related A note tone signals; and with both transistors T33 and T34 turned on by signals on busses OB3 and OB4, the A4 tone signal on lead 176 would be effectively gated to output lead 191. This corresponds to the lowest note played, which is not the needed melody note, and is not in the octave in which the A note is played. From this example, it will be seen that the low octave lockout circuit is vital to providing an integrated organ-synthesizer system if polyphonic organ playing and monophonic melody note synthesizer playing are to be accomplished simultaneously on the same upper keyboard of the organ. Without low octave lockout, only melody notes, one note at a time, could be played in detached fashion and while this might be minimally satisfactory to novice organists, it would not be satisfactory for the accomplished organist. Low octave lockout circuit is also preferable for a stand-alone version of a synthesizer according to this invention in order to permit legato playing without producing the wrong note in certain instances. For example, if A4 is played and then D5 is played before A4 is released, without low octave lockout circuit 30, the A4 tone signal would switch to A5 when D5 is played because of the keying signal on higher octave bus OB5. Then when A4 is released D5 would sound. This is highly undesirable from a musical standpoint and would not be tolerated by an accomplished player. With low octave lockout circuit, playing D5 would lock out A4 and only D5 would sound.

From the description of FIGS. 3 and 4, it should be readily apparent that a low note select system could readily be produced by reversing octave lockout circuit 30 to ground out octave busses higher than the lowest one on which a signal appears and by reversing the end of the note and octave preference gating arrangements from which signals are taken. Moreover, by providing duplicate note and octave collect circuits, isolated by resistors R1 in each case, and separate low and high octave lockout circuits, low and high note and octave preference gates, and frequency dividers, a combined high and low note synthesizer system could be provided. This system would permit harmonizing effects with the same voice or control setup. Or each half could have its own separate filtering and gating to produce different voices.

As noted above, since low octave lockout circuit 30 permits only one of the common octave busses OB1 to OB5 to have a keying signal thereon, octave gating circuit 190 need not be a preference gating circuit and the circuit illustrated in FIG. 6 can be substituted without loss of the high note select function. In FIG. 6 each of the octavely related tone signals on leads 175 to 179 is independently gated with preference by transistor gates comprising transistors T31 to T35 with associated circuit components R19, R20 and R26. Resistors R27 and R28 form a voltage divider to set the initial DC level on lead 191.

The system of FIG. 6 is also useful in the FIG. 2 embodiment which eliminates low octave lockout circuit 30 and is restricted to detached single note playing. The note gating system of FIG. 5 also gates each tone signal without preference and is useful in a system which is to be limited to detached one note playing since no preference gating is needed when only one keyswitch at a time is to be actuated. Each of the transistors T15 to T17 with associated circuit elements R6 to R8 and R23 form a transistor gate. Resistors R24 and R25 form a voltage divider to set an initial DC level on lead 161.

FIG. 7 shows a volts per octave circuit which comprises a voltage divider string of at least sixty-one diodes D6 fed by a constant current source comprising transistors T41 and T42 and related circuit components and sixty-one transistor gates such as transistors T36 to T40. Each of the 61 transistor gates is controlled by individual keying signals from keyswitches 12 in keyboard 10 via cable 12. The highest keyswitch actuated turns on its associated transistor gate to ground out a junction between two diodes at a corresponding position in the diode divider string. The resulting forward voltage drop across the diode string is an output at terminal 231 which is directly proportional to the position of the highest key actuated. This signal is useful to produce pitch slide effects as are detailed in the above-referenced copending Schreier application.

The invention has been described in relation to a sixty-one-note keyboard which is the keyboard length of many console organs. It should be apparent that lesser or greater octaves of notes could readily be accommodated by decreasing or increasing the number of common octave busses, and frequency divider stages. Moreover, if the top octave tone generator in an integrated organ-synthesizer unit is to be shared and the top octave frequencies are at a higher pitch than desired for the synthesizer portion of the system, additional frequency divider stages could be added to divider 170 to lower the frequency. Finally it should be understood that the resistors R1 in FIG. 3 are not required in a stand-alone version of invention or in the FIG. 2 embodiment without low octave lockout because their purpose is to isolate polyphonic organ keying circuits from the grounding of keying signals produced by low octave lockout circuitry at the input of the note collect circuits. Numerous other modificiations could be made in the above-described embodiments of this invention, such as those disclosed in the above-referenced Mathias and Schreier applications, without departing from the scope of this invention as claimed in the following claims.

I claim:

1. A single note selecting storage circuit for an electronic musical instrument having tone generators which deliver output tone signals of an octave, said single note selecting storage circuit comprising:

a plurality of switch means operably designatable of a desired octaval note name and number in a predetermined series of octaves;

note name selector means coupled to said switch means for receiving an octave of predetermined tone signals from said generator and delivering a first tone signal therefrom representative of a particular note name of said octave in response to an operated one of said switch means, said particular note name being the same as the note name designated by said operated one of said switch means;

at least one one-half frequency divider means connected to said note name selector means for frequency-dividing the first tone signal delivered therefrom into a second tone signal which is an octave lower than said first tone signal; and octave selector means operatively coupled to said switch means for receiving said first and second tone signals from said note name selector means and said frequency divider means respectively and delivering an output signal of one of said first and second tone signals having an octaval number, corresponding to the octaval number operably designated in said switch means upon operation of said operated one of said switch means.

2. A monophonic electronic musical instrument comprising:

a plurality of selectively actuable control elements for producing control signals on separate output leads, each control element being associated with a particular note of the musical scale in one of a plurality of octaves;

means for collecting control signals associated with common notes in different octaves on common note busses;

means for collecting control signals associated with common octaves on common octave busses;

tone signal generating means for generating at least the highest octave of tone signals on separate tone signal busses;

note gating means for gating one of said tone signals in response to a control signal on an associated common note bus;

means for dividing said gated tone signal into a plurality of octavely related tone signals; and octave gating means for gating one of said octavely related tone signals in response to a control signal on an associated common octave bus.

3. Apparatus as claimed in claim 2, wherein said octave gating means comprises octave lockout means for locking out control signals from all but one octave of control elements to determine an active octave; and said note gating means comprises note preference gating means for gating only one tone signal in the event of coincident actuation of more than one of said control elements in said active octave.

4. Apparatus as claimed in claim 3, wherein said octave lockout means comprises a low octave lockout means responsive to a control signal on one of said common octave busses to lock out all control signals from control elements associated with lower octaves; and said note preference gating means comprises a high note preference gating means for gating only the highest one of said tone signals in the event of coincident actuation of more than one of said control elements in the corresponding active octave.

5. Apparatus as claimed in claim 4, wherein said tone signal generating means comprises a single master oscillator and divider circuit means driven by said oscillator to generate all of the tone signals corresponding to the highest octave of notes to be gated.

6. A monophonic electronic musical instrument comprising:

a plurality of selectively actuable control elements for producing control signals on separate output leads, each control element being associated with a particular note of the musical scale in one of a plurality of octaves;

a set of common note busses, each assocciated with a particular one of the notes of the musical scale;

a set of common octave busses each associated with one of said plurality of octaves of musical notes;

note collect circuit means for collecting control signals associated with common notes on said common note busses;

octave collect circuit means for collecting control signals associated with common octaves on said common octave busses;

tone signal generating means for generating at least the highest octave of tone signals on separate tone signal busses;

note gating means coupled to said common note busses and said tone signal busses for gating onto a note signal bus an associated one of said tone signals in response to a control signal on one of said common note busses;

divider circuit means coupled to said note signal bus for producing a plurality of octavely related output tone signals on separate divider output busses; and octave gating means coupled to said common octave busses and said divider output busses for gating to an octave signal bus an associated one of said tone signals on said divider output busses in response to a control signal on one of said common octave busses.

7. Apparatus as claimed in claim 6, wherein said octave gating means comprises lock out means for locking out control signals from all but one octave of control elements to determine an active octave; and said note gating means comprises note preference gating means for gating only one tone signal in the event of coincident actuation of more than one of said control elements in said active octave.

8. Apparatus as claimed in claim 7, wherein said octave lockout means comprises a low octave lockout means responsive to a control signal on one of said common octave busses to lock out all control signals from control elements associated with lower octaves; and said note preference gating means comprises a high note preference gating means for gating only the highest one of said tone signals in the event of coincident actuation of more than one of said control elements in the corresponding active octave.

9. Apparatus as claimed in claim 6, wherein said note collect circuit means comprises a plurality of note collect circuits, one for each note of the musical scale, and each of said note collect circuits comprises a logic OR gate having inputs from each associated control element in each octave; and said octave collect circuit means comprises a plurality of octave collect circuits, one for each octave of control elements, and each of said octave collect circuits comprises a logic OR gate having inputs from each control element in an associated octave.

10. Apparatus as claimed in claim 9, wherein each of said logic OR gates comprises a plurality of diodes coupled between respective common note and common octave busses and associated control elements.

11. In an electronic musical instrument having a polyphonic tone generating system comprising:

a control signal source;

a plurality of selectively actuable control elements coupled in parallel to said control signal source for producing keying control signals and being associated with notes of the musical scale in one of a plurality of octaves;

a top octave tone signal generator for generating the highest octave of tone signals on separate tone signal busses;

a plurality of tone divider circuits coupled to said tone signal busses for generating octavely related tone signals; and DC keying circuits coupled to said tone divider circuits and said control elements for gating tone signals corresponding to each of said control elements actuated; a high note select, monophonic tone generating subsystem comprising:

note collecting means for collecting keying control signals associated with common notes in different octaves on common note busses;

octave collecting means for collecting keying control signals associated with common octaves on common octave busses;

high-note preference gating means for gating only a highest one of said tone signals from said top octave tone generator in response to a keying control signal on a highest one of said common note busses;

monophonic divider circuit means receiving said highest tone signal for producing a plurality of octavely related tone signals; and a high octave preference circuit responsive to a keying control signal on a highest one of said common octave busses to lock out all keying signals from control elements in lower octaves at the inputs of said note collecting means and said octave collecting means and to gate an associated one of said tone signals from said monophonic divider circuit means;

said note and octave collecting means being decoupled in a D.C. manner from said control elements whereby a plurality of said D.C. keying circuits may be operated for polyphonic musical effects at the same time that the highest control element actuated produces monophonic musical effects.

12. Apparatus as claimed in claim 11, wherein said control elements comprise a single keyswitch per key on an electronic musical instrument with one side of each coupled to said control signal source; said D.C. keying circuits being directly coupled to the other sides of said switches, with a D.C. decoupling resistor connected between each of said keyswitches and said note and octave collecting means.

* * * * *